United States Patent [19]

Yotoriyama

[11] 4,383,635

[45] May 17, 1983

[54] DISPOSABLE CONTAINER

[76] Inventor: Minoru Yotoriyama, 7-2 Itakura-cho, Ashikaga-shi, Tochigi, Japan

[21] Appl. No.: 198,006

[22] PCT Filed: Feb. 15, 1980

[86] PCT No.: PCT/JP80/00021

§ 371 Date: Oct. 15, 1980

§ 102(e) Date: Oct. 15, 1980

[30] Foreign Application Priority Data

Feb. 15, 1979 [JP] Japan ..... 54-17059[U]

[51] Int. Cl.[3] ..... B65D 33/02

[52] U.S. Cl. ..... 229/1.5 H; 220/401; 248/99

[58] Field of Search ..... 229/1.5 H; 220/401, 220/404, 405, 85 H; 248/99, 100, 101

[56] References Cited

U.S. PATENT DOCUMENTS

| | | | |
|---|---|---|---|
| 2,730,278 | 1/1956 | Sherlowsky | 229/1.5 H |
| 2,782,616 | 2/1957 | Eron | 229/1.5 H |
| 2,991,907 | 7/1961 | Kinnison | 220/85 H |
| 3,409,207 | 11/1968 | Eicholtz | 229/1.5 H |
| 3,456,864 | 7/1969 | Trombley | 229/1.5 H |

FOREIGN PATENT DOCUMENTS 54-56660 4/1979 Japan .

*Primary Examiner*—Stephen P. Garbe
*Attorney, Agent, or Firm*—Oblon, Fisher, Spivak, McClelland & Maier

[57] ABSTRACT

A container member is formed in a shape befitting accommodation and use of the substance to be contained therein, with a synthetic resin material capable of retaining its shape. This container member is provided along the open edge thereof with an extended edge adapted to be folded down outwardly. The container member is supported on a receptacle member having an upper edge possessed of a shape substantially similar to the outer shape of the open edge of the container member and disposed at the same height as the open edge, whereby the aforementioned extended edge, when folded down outwardly, firmly grips the upper edge of the receptacle member. After the container member is used, the folded portion of the extended edge is elongated to have the container member released from the receptacle member and thrown away.

5 Claims, 3 Drawing Figures

DISPOSABLE CONTAINER

FIELD OF THE INVENTION

This invention relates to a disposable container which is designed to be thrown away after a single use.

DESCRIPTION OF THE PRIOR ART

In an automobile repair shop, for the purpose of coating a repaired portion on a car body with a paint of the same color as the immediately surrounding portion, for example, it becomes necessary to mix two or more paints in a mixing container to produce a paint of the desired color and coat the repaired portion with the mixed paint. Then, the container must be emptied of the unused paint and washed with a solvent such as a thinner to remove the portion of the paint still adhering to the container. The amount of the thinner used for the washing usually ranges roughly from 300 to 1000 cc and the time required by the worker for completing this task ranges from 10 to 30 minutes. This is troublesome work and jeoparidzes the worker's health because of the possibility of inhalation of thinner vapor.

Disposable cups used for drinking water have already acquired wide popularity. Those containers are shaped to forms befitting their respective intended applications and adapted to provide stability and ease of use, and they are generally expensive. Despite the great trouble of the work of washing as involved in the case of the mixing container used for the preparation of a paint as described above, many containers are still being used repeatedly between the steps of washing.

In consequence of a study continued on such problems of the conventional containers, the inventor became aware that the functions of containers, on analysis, are divided into the function of accommodation and the function of handling and that when, in the place of a one-piece container combining these two functions, two separate members adapted to fulfill such different functions respectively are assembled in a separable manner, only the member fulfilling the function of accommodation and soiled by the content remaining after use can be separated and thrown away. This idea was applied to the aforementioned paint mixing container: A receptacle member conforming to the configuration of a container of the kind heretofore used for a similar purpose was prepared, a container member of the shape of an ordinary drinking glass was formed of a synthetic resin and the container member was set in position inside the receptacle member. When the assembled container was put to use, it was learnt that the paint tended to smear the receptacle member when the assembled container was tilted to pour out the paint and the container member would slip out of the receptacle member when the assembled container was tilted to a certain degree. These facts constituted obstacles to effective use of the assembled container. The present invention has been perfected to overcome these drawbacks. The basic idea of the invention relates to providing an extended edge on the upper end of the container member inserted in the receptacle member and, after the container member has been secured within the receptacle member, folding down the extended edge outwardly and thereby causing the folded portion to take a firm hold of the upper edge of the receptacle member.

SUMMARY OF THE INVENTION

The disposable container of the present invention comprises, in combination, a disposable container member possessed of a shape suitable for accommodation and use of a substance to be contained therein, made of a thin-walled synthetic resin material capable of self-sustaining the shape mentioned above and provided at the upper end thereof with an extended edge which is folded down outwardly; and a receptacle member including an upper-edge portion of size and shape such that it receives a squeezing force on the periphery thereof when it is received under the folded-back portion of the aforementioned extended edge of the container member, a supporting portion continuing into the upper-edge portion and serving to retain the upper-edge portion in a desired posture and also optionally serving to hold in position the barrel of the container member when the assembled container is tilted, and a grip. The disposable container of the present invention is so constructed that, after use, only the container member is removed from the receptacle member and thrown away. Thus, the disposable container does away with the labor otherwise required for the washing of the container soiled by the unused residue of the substance and with the facilities and the cleansing agent used for the washing. It is economical in the respect that the container member may be molded of an inexpensive synthetic resin.

BRIEF DESCRIPTION OF THE DRAWINGS

Various other objects features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
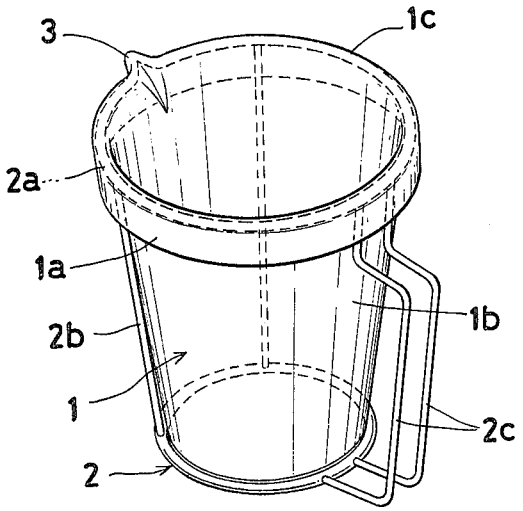
FIG. 1 is a perspective view of one embodiment of the disposable container according to the present invention.
Figure 3:
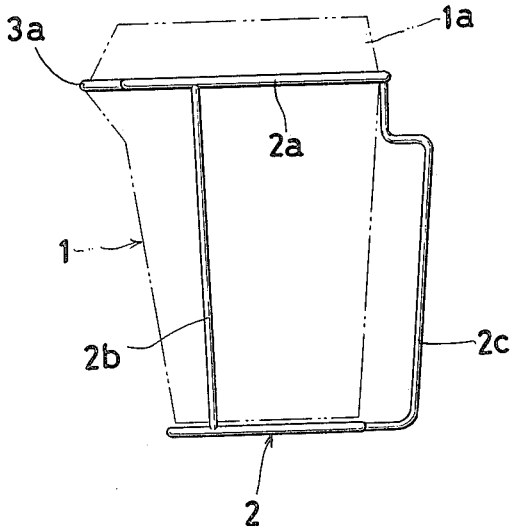
FIG. 3 is a side view of the receptacle member of the disposable container of FIG. 1.
Figure 2:
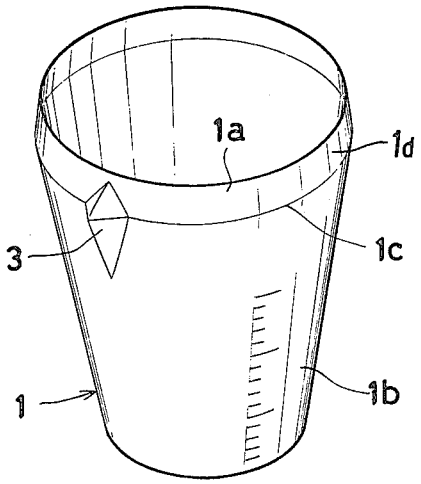
FIG. 2 is a perspective view of the container ready for assemblage with a receptacle member to form the disposable container of FIG. 1.

FIG. 1 represents an embodiment wherein the disposable container of the present invention is utilized as a mixing container for paints, and depicts the condition in which a disposable container member or liquid receiving body 1 and a receptacle member 2 are combined into operative union. FIG. 2 and FIG. 3 illustrate the container member and the receptacle member respectively in the separated form. The chain line indicated in FIG. 3 shows the upwardly extended edge 1*a* of the container member 1 set in position within the receptacle member 2, with the edge 1*a* held in a position ready to be folded down outwardly.

The container member 1 is formed and constructed in a shape suitable for accommodation and use (agitation) of a given substance (paint in this case) with a thin-walled resin material such as well-known polyethylene film capable of retaining a given shape. Along the upper open edge or circumferential edge portion 1*c* of the container member 1, there is provided an extended edge portion 1*a* adapted so as to be folded down outwardly and including an upper leading edge portion 1*d*.

The receptacle member or frame 2 serving to support therein the aforementioned container member 1 is formed in a shape suitable for holding the container member fast therein. The upper edge 2*a* of the receptacle member 2 is flush with the upper open edge 1*c* of the container member 1, so that the extended edge 1*a* of the container member, when folded down outwardly, wraps itself around the upper edge 2*a* of the receptacle member 2 and grips firmly thereon.

Thus, the extended edge 1*a* is folded down to cover and squeeze the upper edge 2*a* of the receptacle member 2.

The receptacle member 2 is constructed of an upper-edge portion 2*a* of size and shape such that is is squeezed on the periphery thereof when it is received under the folded-back portion of the aforementioned extended edge 1*a* of the container member 1, a supporting portion 2*b* continuing into the upper-edge portion 2*a* and serving to retain the upper-edge portion in a desired posture (horizontal) and also optionally serving to hold in position the barrel 1*b* of the container member when the assembled container is tilted, and a hard grip 2*c*. In the description given so far, words enclosed in parentheses relate to specific matters involved in the embodiment under discussion.

The container member 1 and the receptacle member 2 are put to use in their combined state and, after use, only the container member 1 soiled by the content remaining after use is removed and replaced with a new supply for the next use.

This operation does not exclusively apply to the embodiment described so far. Whenever the container member 1 is inserted into the receptacle member 2, the open edge 1*c* of the container member which constitutes itself the edge of the whole container never fails to run along the inner side of the upper edge 2*a* of the receptacle member. In order that the upwardly extended edge 1*a* projecting upwardly from the open edge 1*c* may be folded down outside the upper end 2*a* of the receptacle member, at least the portion immediately above the open edge 1*c* of the container member must be expansible in the circumferential direction. Otherwise, no effective folding is obtained. The portion of the container which is folded down, therefore, is destined to squeeze the outer surface of the upper edge 2*a* of the receptacle member.

In the present embodiment, however, the circumferential length at the top end of the extended edge 1*a* of the container member is made shorter than the length of the inside circumference of the open edge 1*c* of the container member so as to add further to the strength with which the squeezing is effected. As a result, when the extended edge 1*a* is folded down, the entire length thereof will be elongated to produce the squeezing force.

Since the assembled container in the present embodiment is utilized as a paint mixing container, it is required to possess a lip through which the paint is poured into a spray gun. For this purpose, the corresponding positions of the open edge 1*c* of the container member and the upper edge 2*a* of the receptacle member are projected outwardly to form pouring lips 3, 3*a* respectively. Assemblage of the disposable container illustrated in FIG. 1 is easily accomplished by inserting the container member 1 of FIG. 2 into the receptacle member 2 as shown in FIG. 3 and then folding down the part of the extended edge 1*a* in the neighborhood of the pouring lip 3 and finally folding down the remaining portion of the extended edge. Optionally, the extended edge 1*a* may be formed in a state folded down from the beginning at the time that the container member 1 is fabricated. In this case, the downwardly folded edge 1*a* may be stretched out to allow the insertion of the container member 1 in the receptacle member 2.

To suit the purpose of paint blending, the container member 1 of the present embodiment is made of a white translucent material and has a measuring scale graduated on the wall thereof.

Generally, the economy of the container member increases in proportion as the thin-walled resin material making up the container member is reduced in thickness to the allowable minimum at which the container member is capable of retaining its own shape when not supported within the receptacle member. If the thickness is too small for the container member to retain its own shape when not held within the receptacle member, the convenience of handling required as when a plurality of container members are piled up for the purpose of storage or when each container member is set in position within the receptacle member is impaired.

The height of the container member may well be such that the container member will be supported in position within the receptacle member with the bottom thereof kept out of contact with the floor rather than in contact therewith. So far as the container member possesses at least the aforementioned allowable minimum wall thickness, it is capable of supporting the weight of the content owing to the squeezing force exerted thereon by the folded portion of the extended edge. This squeezing force and the appropriate tenacity of the wall of the container member cooperate to withstand external impacts generated when the container is carried around, exposed to vibration or tilted even when the receptacle member is formed solely of a framework as in the aforementioned embodiment.

The receptacle member 2 may be fabricated of synthetic resin, metal sheet or wood in a shape resembling the configuration of the container member 1. When it is made of metal wire as in the embodiment described above, it enjoys light weight and low cost in conjunction with high sturdiness. In the present embodiment, the receptacle member is of a type which is obtained by producing from a thick iron wire a circular ring of the upper edge portion 2*a*, laterally symmetrical support columns of the support portion 2*b*, a circular ring at the bottom and two grips 2*c* and assembling all these parts as required by welding or soldering. It is formed by fast connection of the upper and lower circular rings through the medium of two supporting columns and two grips. Thus, the receptacle member is produced by effective assemblage of the smallest possible number of components. The laterally symmetrical support columns of the support portion 2*b* fulfills an additional function of keeping in position of wall 1*b* of the container member when the whole container is tilted to pour out the paint. Of course, the receptacle member may be modified in various ways as by making the grips 2*c* alone with metal sheet of forming the grips with wood or synthetic resin.

When the subject to be held in the container member is something other than paint, the container member and the receptacle member may be formed in some other shape befitting the accommodation and handling of the particular substance. They can easily be designed by any person of ordinary skill in the art with due reference to the embodiment described above.

This invention contemplates dividing a container into a container member and a receptacle member and relying solely upon the receptacle member to fulfill the functions of stabilizing the whole container and permitting required handling thereof and thereby enabling the container member alone to be thrown away and replaced with a new one. It further contemplates adding an upwardly extended edge to the container member and, through full utilization of the resiliency of the thin-walled resin material used, allowing the extended edge to be folded down over the edge of the receptacle member and thereby permitting ready fast assemblage of the two members. The folded portion exerts enough binding force to prevent the two members from easy separation.

In short, the present invention confers upon the disposable container the function of enabling a low-cost disposable container to be handled in the same manner as any other ordinary container.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A disposable container comprising:

a liquid receiving body formed of a thin synthetic resin material capable of retaining its shape when empty and having a base;

an extended edge portion formed of said synthetic resin and projecting upwardly from said receiving body and having an upper leading edge portion;

a circumferential edge portion formed of said synthetic resin and separating said extended edge portion from said receiving body and having a circumference greater than the circumference of said upper leading edge portion of said extended edge portion;

said synthetic resin material further comprising a pliant synthetic resin material such that said extended edge portion can be folded down and outwardly from said upper leading edge about said circumferential edge portion;

a receptacle frame for supporting said receiving body in a required posture and having an upper edge formed in a shape substantially the same as an outer shape of said circumferential edge portion and being disposed at a height substantially the same as the distance of said circumferential edge portion from said base such that said upper edge of said receptacle frame is squeezed by said circumferential edge portion when said extended edge portion of said receiving body is folded down and outwardly over said upper edge of said receptacle frame; and hand gripping means integrally connected to said receptacle frame.

2. The disposable container according to claim 1, wherein said liquid receiving body further comprises a shape of an upwardly diverging cylinder diverging from a bottom portion of said liquid receiving body up to said circumferential edge portion and wherein said extended edge portion further comprises a shape of an upwardly converging cylinder converging from said circumferential edge portion to said upper leading edge, said liquid receiving body and said extended edge portion maintaining said resepective diverging and converging shapes while being supported within said receptacle frame.

3. The disposable container according to claim 1 or claim 2, wherein said synthetic resin material further comprises a semitransparent polyethylene fiber.

4. The disposable container according to claim 1, wherein said upper edge of said receptacle frame further comprises a first annular frame member having an inner diameter substantially the same as the diameter of said circumferential edge portion, wherein said receptacle frame further comprises a second annular frame member having an inner diameter substantially the same as the diameter of a bottom portion of said liquid receiving body, and wherein said receptacle frame further comprises a plurality of supporting members for connecting said first and said second annular frame members such that said first annular frame member is held at a height substantially the same as the height of said circumferential edge portion.

5. The disposable container according to claim 1, further comprising first and second means projecting radially outwardly from said liquid receiving body and from said extended edge portion, respectively, for pouring said liquid, said first and second means for pouring being connected by means disposed about an axis coplanar with said circumferential edge for pliantly interconnecting said first and second means for pouring, such that upon said extended edge portion being folded down and outwardly, said second means for pouring nests within said first means for pouring.

* * * * *